US011085430B2

(12) United States Patent
Matsumoto et al.

(10) Patent No.: US 11,085,430 B2
(45) Date of Patent: Aug. 10, 2021

(54) GAS LEAK DETERMINING METHOD, AND MULTI-STAGE COMPRESSOR

(71) Applicant: Kobe Steel, Ltd., Hyogo (JP)

(72) Inventors: Yasuharu Matsumoto, Takasago (JP); Takayuki Fukuda, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 98 days.

(21) Appl. No.: 16/312,237

(22) PCT Filed: Jun. 26, 2017

(86) PCT No.: PCT/JP2017/023384

§ 371 (c)(1),
(2) Date: Dec. 20, 2018

(87) PCT Pub. No.: WO2018/020925

PCT Pub. Date: Feb. 1, 2018

(65) Prior Publication Data

US 2019/0331103 A1 Oct. 31, 2019

(30) Foreign Application Priority Data

Jul. 26, 2016 (JP) ..... JP2016-146562

(51) Int. Cl.
*F04B 25/02* (2006.01)
*F04B 49/06* (2006.01)
(Continued)

(52) U.S. Cl.
CPC ..... *F04B 25/02* (2013.01); *F04B 25/00* (2013.01); *F04B 25/005* (2013.01); *F04B 41/06* (2013.01);
(Continued)

(58) Field of Classification Search
CPC .... F04B 2207/042; F04B 25/02; F04B 25/00; F04B 25/005; F04B 41/06; F04B 49/10;
(Continued)

(56) References Cited

U.S. PATENT DOCUMENTS 3,190,545 A * 6/1965 Weber ..... F04B 39/04 417/248
5,195,874 A * 3/1993 Odagiri ..... F04B 39/06 137/204
(Continued)

FOREIGN PATENT DOCUMENTS

JP S58-047187 A 3/1983
JP 2006178712 A 7/2006
JP 2011007098 A 1/2011

OTHER PUBLICATIONS

International Preliminary Report on Patentability issued in corresponding International Application No. PCT/JP2017/023384; dated Feb. 7, 2019.
(Continued)

*Primary Examiner* — Peter J Bertheaud
(74) *Attorney, Agent, or Firm* — Studebaker & Brackett PC

(57) ABSTRACT

A gas leak determining method for a multi-stage compressor including: a first compressing unit that compresses a gas; and a second compressing unit that further compresses the gas compressed by the first compressing unit includes: a step of calculating a proportion of discharge pressure from the second compressing unit to discharge pressure from the first compressing unit or suction pressure into the second compressing unit; and a step of determining that a gas is leaking from the second compressing unit when the proportion becomes equal to or less than a set value.

2 Claims, 2 Drawing Sheets

(51) Int. Cl.

| | |
|---|---|
| ***F04B 49/10*** | (2006.01) |
| ***F04B 41/06*** | (2006.01) |
| ***F04B 25/00*** | (2006.01) |
| ***F04B 49/02*** | (2006.01) |
| *F04B 53/14* | (2006.01) |

(52) U.S. Cl.
CPC ..... *F04B 49/022* (2013.01); *F04B 49/065* (2013.01); *F04B 49/10* (2013.01); *F04B 53/14* (2013.01); *F04B 2201/0208* (2013.01); *F04B 2201/0605* (2013.01); *F04B 2201/0803* (2013.01); *F04B 2205/063* (2013.01)

(58) Field of Classification Search
CPC ..... F04B 2201/0605; F04B 25/04; F04B 2201/0208; F04B 2201/0803; F04B 2205/01; F04B 49/022; F04B 49/065
See application file for complete search history.

(56) References Cited

U.S. PATENT DOCUMENTS

| | | | | |
|---|---|---|---|---|
| 5,863,186 | A * | 1/1999 | Green | F04B 9/113 417/244 |
| 9,677,556 | B2 * | 6/2017 | Worden | F04B 25/00 |
| 10,233,920 | B2 * | 3/2019 | Worden | F04B 25/00 |
| 2010/0054958 | A1 * | 3/2010 | Hartl | F04B 25/00 417/53 |
| 2013/0294934 | A1 * | 11/2013 | Worden | F04B 51/00 417/53 |
| 2016/0169216 | A1 | 6/2016 | Okuno et al. | |

OTHER PUBLICATIONS

Extended European Search Report issued by the European Patent Office dated Mar. 19, 2019, which corresponds to EP17833934.7-1004 and is related to U.S. Appl. No. 16/312,237.

* cited by examiner

FIG. 2

| | FIRST STAGE | | SECOND STAGE | | THIRD STAGE | | FOURTH STAGE | | FIFTH STAGE | |
|---|---|---|---|---|---|---|---|---|---|---|
| | SUCTION | DISCHARGE | SUCTION | DISCHARGE | SUCTION | DISCHARGE | SUCTION | DISCHARGE | SUCTION | DISCHARGE |
| PRESSURE (Mpa) | 0.6 | 2.5 | 2.5 | 8 | 8 | 20 | 20 | 45 | 45 | 82 |

GAS LEAK DETERMINING METHOD, AND MULTI-STAGE COMPRESSOR

TECHNICAL FIELD

The present invention relates to a gas leak determining method for a multi-stage compressor.

BACKGROUND ART

Conventionally, reciprocating multi-stage compressors are known. For example, Patent Literature 1 discloses a multi-stage compressor having five compressing units. Each compressing unit includes a cylinder having a compressing chamber, a piston, and a piston ring provided on the piston. A gas suctioned into a first compressing chamber of a first compressing unit is compressed in order from the first compressing unit, and is discharged from a fifth compressing unit.

In the multi-stage compressor described in Patent Literature 1, a gas may leak from each compressing unit (gas may leak from a compressing chamber to a space lower than the compressing chamber in pressure), and there are needs for detecting this gas leak.

CITATION LIST

Patent Literature

Patent Literature 1: JP 2016-113907 A

SUMMARY OF INVENTION

An object of the present invention is to provide a multi-stage compressor that can detect a gas leak, and a gas leak determining method for the multi-stage compressor.

A gas leak determining method according to one aspect of the present invention is a gas leak determining method for a multi-stage compressor including: a first compressing unit that compresses a gas; and a second compressing unit that further compresses the gas compressed by the first compressing unit, the gas leak determining method including: a step of calculating a proportion of discharge pressure from the second compressing unit to discharge pressure from the first compressing unit or suction pressure into the second compressing unit; and a step of determining that a gas is leaking from the second compressing unit when the proportion becomes equal to or less than a set value.

A multi-stage compressor according to one aspect of the present invention includes: a first compressing unit compressible a gas; a second compressing unit compressible the gas compressed by the first compressing unit; and a determining unit, wherein the determining unit determines that a gas is leaking from the second compressing unit, when a proportion of discharge pressure from the second compressing unit to discharge pressure from the first compressing unit or suction pressure into the second compressing unit becomes equal to or less than a set value.

BRIEF DESCRIPTION OF DRAWINGS

FIG. 2 is a diagram showing an example of suction pressure and discharge pressure in each compressing unit of the multi-stage compressor shown in FIG. 1.

DESCRIPTION OF EMBODIMENTS

Figure 1:
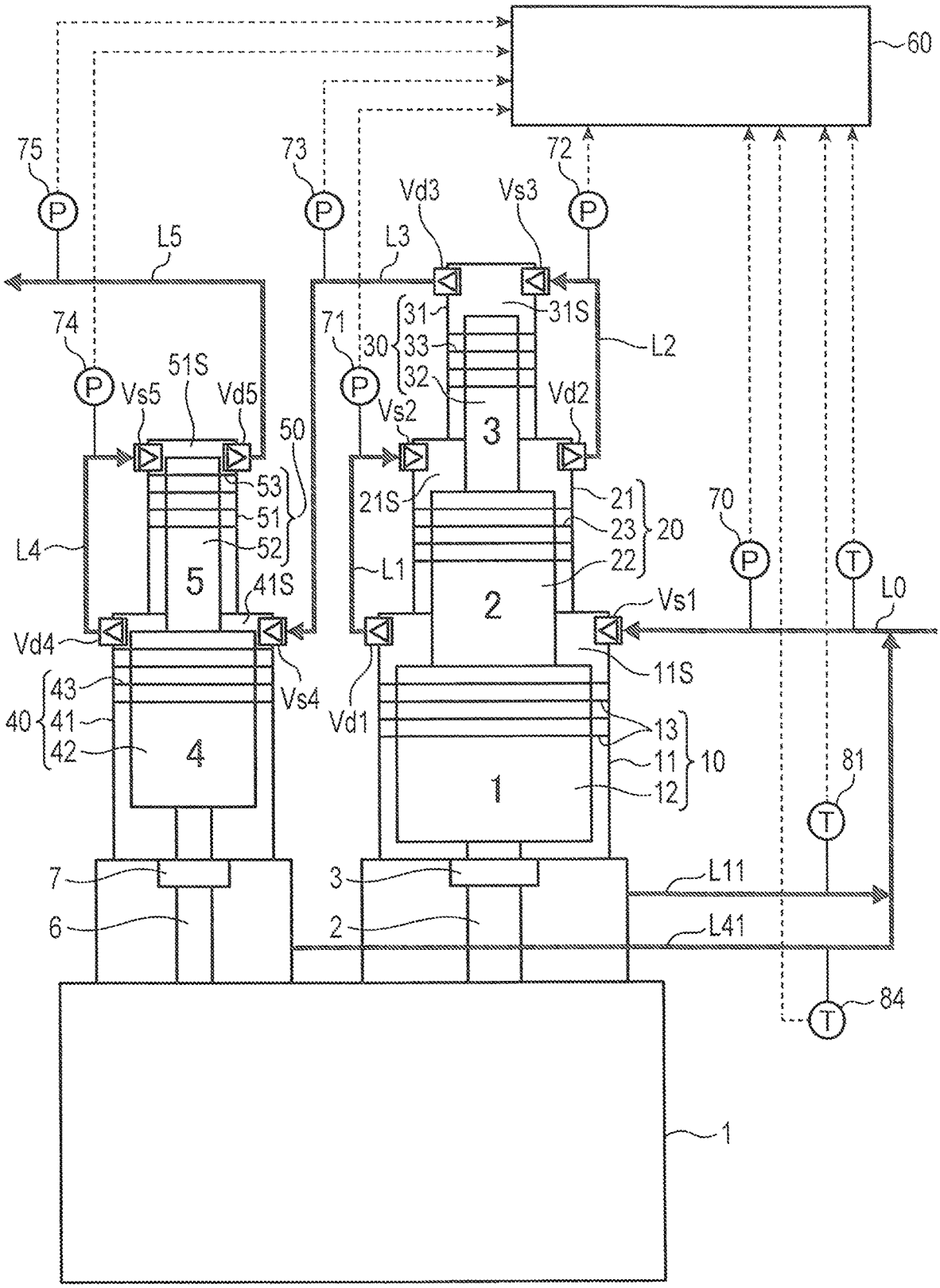
FIG. 1 is a diagram schematically showing a configuration of a multi-stage compressor of one embodiment of the present invention.

A multi-stage compressor of one embodiment of the present invention will be described with reference to FIG. 1.

As shown in FIG. 1, the multi-stage compressor includes a crank case 1, a plurality of (five in the present embodiment) compressing units 10 to 50, and a determining unit 60. In the present embodiment, each of the compressing units 10 to 50 compresses a hydrogen gas.

The first compressing unit 10 includes a first cylinder 11 including a first compressing chamber 11S, a first piston 12, a first piston ring 13 provided on the first piston 12, a first suction valve Vs1 provided on a suction side of the first compressing chamber 11S, and a first discharge valve Vd1 provided on a discharge side of the first compressing chamber 11S. The first piston 12 is connected to a first rod 2 which is connected to a crankshaft (not shown) disposed in the crank case 1. A first distance piece 3 is provided in the first rod 2.

The configurations of the second compressing unit 20 to the fifth compressing unit 50 are basically similar to the configuration of the first compressing unit 10. That is, the second compressing unit 20 includes a second cylinder 21 including a second compressing chamber 21S, a second piston 22, a second piston ring 23, a second suction valve Vs2, and a second discharge valve Vd2. The third compressing unit 30 includes a third cylinder 31 including a third compressing chamber 31S, a third piston 32, a third piston ring 33, a third suction valve Vs3, and a third discharge valve Vd3. The fourth compressing unit 40 includes a fourth cylinder 41 including a fourth compressing chamber 41S, a fourth piston 42, a fourth piston ring 43, a fourth suction valve Vs4, and a fourth discharge valve Vd4. The fifth compressing unit 50 includes a fifth cylinder 51 including a fifth compressing chamber 51S, a fifth piston 52, a fifth piston ring 53, a fifth suction valve Vs5, and a fifth discharge valve Vd5. The second piston 22 is connected to the first piston 12. The third piston 32 is connected to the second piston 22. The fourth piston 42 is connected to a second rod 6 which is connected to the crankshaft. A second distance piece 7 is provided in the second rod 6. The fifth piston 52 is connected to the fourth piston 42. Note that a size of each of the cylinders 21 to 5152 (each of the compressing chambers 21S to 51S) gradually decreases toward a high-pressure side (toward a fifth compressing unit 50 side). This also applies to a size of each of the pistons 22 to 52.

The present embodiment includes a suction line L0, a first connecting line L1, a second connecting line L2, a third connecting line L3, a fourth connecting line L4, a discharge line L5, a first return line L11, and a second return line L41. The suction line L0 supplies a gas to the first compressing chamber 11S via the first suction valve Vs1. The first connecting line L1 guides the gas discharged from the first compressing chamber 11S via the first discharge valve Vd1 to the second compressing chamber 21S via the second suction valve Vs2. The second connecting line L2 guides the gas discharged from the second compressing chamber 21S via the second discharge valve Vd2 to the third compressing chamber 31S via the third suction valve Vs3. The third connecting line L3 guides the gas discharged from the third compressing chamber 31S via the third discharge valve Vd3 to the fourth compressing chamber 41S via the fourth suction valve Vs4. The fourth connecting line L4 guides the gas discharged from the fourth compressing chamber 41S via the fourth discharge valve Vd4 to the fifth compressing chamber 51S via the fifth suction valve Vs5. The discharge line L5 takes out the gas compressed by the fifth compressing chamber 51S to outside via the fifth discharge valve Vd5. The first return line L11 returns, to the suction line L0, the gas leaked from the first compressing chamber 11S to the crank case 1 side via a gap between the first cylinder 11 and the first piston ring 13. The second return line L41 returns, to the suction line L0, the gas leaked from the fourth compressing chamber 41S to the crank case 1 side via a gap between the fourth cylinder 41 and the fourth piston ring 43.

The determining unit 60 determines whether a gas is leaking from each of the compressing units 10 to 50. Hereinafter, detection of a gas leak resulting from deterioration of sealing performance of each of the suction valves Vs1 to Vs5 or each of the discharge valves Vd1 to Vd5, and detection of a gas leak resulting from wear of each of the piston rings 13, 23, 33, 43, and 53 will be described in this order.

For example, when the sealing performance of the fifth discharge valve Vd5 or the fifth suction valve Vs5 deteriorates, suction pressure into the fifth compressing unit 50, that is, discharge pressure from the fourth compressing unit 40 rises. Therefore, by monitoring a proportion of discharge pressure from the fifth compressing unit 50 to the suction pressure into the fifth compressing unit 50 or the discharge pressure from the fourth compressing unit 40 (hereinafter referred to as "fifth proportion"), it becomes possible to detect deterioration of the sealing performance of the fifth discharge valve Vd5 or the fifth suction valve Vs5, that is, a gas leak from the fifth compressing unit 50. Specifically, when the sealing performance of the fifth discharge valve Vd5 or the fifth suction valve Vs5 deteriorates, the fifth proportion will decrease. Therefore, the determining unit 60 calculates the fifth proportion regularly, and when the calculated fifth proportion becomes equal to or less than a fifth set value, the determining unit 60 outputs a fifth signal indicating that a gas is leaking from the fifth compressing unit 50.

The above description also applies to a case where the sealing performance of other valves deteriorates. That is, when a fourth proportion (proportion of discharge pressure from the fourth compressing unit 40 to suction pressure into the fourth compressing unit 40 or discharge pressure from the third compressing unit 30) becomes equal to or less than a fourth set value, the determining unit 60 outputs a fourth signal indicating that a gas is leaking from the fourth compressing unit 40. Hereinafter, similarly, when a third proportion becomes equal to or less than a third set value, the determining unit 60 outputs a third signal indicating that a gas is leaking from the third compressing unit 30, when a second proportion becomes equal to or less than a second set value, the determining unit 60 outputs a second signal indicating that a gas is leaking from the second compressing unit 20, and when a first proportion becomes equal to or less than a first set value, the determining unit 60 outputs a first signal indicating that a gas is leaking from the first compressing unit 10.

Note that suction pressure into the first compressing unit 10 is detected by a pressure sensor 70 provided in the suction line L0. Discharge pressure from the first compressing unit 10 (suction pressure into the second compressing unit 20) is detected by a pressure sensor 71 provided in the first connecting line L1. Discharge pressure from the second compressing unit 20 (suction pressure into the third compressing unit 30) is detected by a pressure sensor 72 provided in the second connecting line L2. Discharge pressure from the third compressing unit 30 (suction pressure into the fourth compressing unit 40) is detected by a pressure sensor 73 provided in the third connecting line L3. Discharge pressure from the fourth compressing unit 40 (suction pressure into the fifth compressing unit 50) is detected by a pressure sensor 74 provided in the fourth connecting line L4. Discharge pressure from the fifth compressing unit 50 is detected by a pressure sensor 75 provided in the discharge line L5.

Next, detection when wear occurs in each of the piston rings 13 to 53 will be described.

For example, when wear occurs in the fifth piston ring 53, part of the gas in the fifth compressing chamber 51S flows into the fourth compressing chamber 41S through a gap between the fifth cylinder 51 and the fifth piston ring 53, leading to a rise in suction pressure into the fifth compressing unit 50, that is, discharge pressure from the fourth compressing unit 40. Therefore, in a similar manner to a case where the sealing performance of the fifth discharge valve Vd5 or the fifth suction valve Vs5 deteriorates, the determining unit 60 outputs the fifth signal when the fifth proportion becomes equal to or less than the fifth set value. That is, in the present embodiment, by the determining unit 60 outputting the fifth signal, it is perceived that at least one of deterioration of the sealing performance of the fifth discharge valve Vd5 or the fifth suction valve Vs5, and wear of the fifth piston ring 53 occurs.

The above description also applies to a case where wear occurs in the third piston ring 33 and the second piston ring 23. That is, by the determining unit 60 outputting the third signal, it is perceived that at least one of deterioration of the sealing performance of the third discharge valve Vd3 or the third suction valve Vs3, and wear of the third piston ring 33 occurs. Also, by the determining unit 60 outputting the second signal, it is perceived that at least one of deterioration of the sealing performance of the second discharge valve Vd2 or the second suction valve Vs2, and wear of the second piston ring 23 occurs.

Meanwhile, in the present embodiment, when wear occurs in the fourth piston ring 43, part of the gas in the fourth compressing chamber 41S flows into the suction line L0 through a gap between the fourth cylinder 41 and the fourth piston ring 43 and the second return line L41. At this time, a second temperature T2 of the second return line L41 rises. Therefore, when the second temperature T2 becomes equal to or higher than a second reference temperature T13, the determining unit 60 outputs a signal indicating that wear occurs in the fourth piston ring 43. The above description also applies to a case where wear occurs in the first piston ring 13. That is, when a first temperature T1 of the first return line L11 becomes equal to or higher than a first reference temperature Tα, the determining unit 60 outputs a signal indicating that wear occurs in the first piston ring 13.

Note that the first temperature T1 is detected by a temperature sensor 81 provided in the first return line L11, and the second temperature T2 is detected by a temperature sensor 84 provided in the second return line L41.

As described above, the multi-stage compressor of the present embodiment effectively detects that a gas is leaking from each of the compressing units 10 to 50.

It should be appreciated that the embodiment disclosed this time is in all aspects illustrative and not restrictive. The scope of the present invention is indicated by the appended claims rather than by the foregoing description, and all changes which come within the meaning and scope of the claims and equivalents are therefore intended to be embraced therein.

For example, the embodiment shows an example in which when the third proportion becomes equal to or less than the third set value, the determining unit 60 outputs the third signal indicating that a gas is leaking from the third compressing unit 30. However, the determining unit 60 may output the third signal when the second proportion becomes greater than a predetermined value.

Example

FIG. 2 is a table showing suction pressure and discharge pressure in each of the compressing units 10 to 50 of the multi-stage compressor of the embodiment. Note that numerical values in this table are values when a gas is not leaking from each of the compressing units 10 to 50. In this example, the fifth proportion is 82/45.

Here, when a gas leaks from the fifth compressing unit 50, suction pressure into the fifth compressing unit 50 (discharge pressure from the fourth compressing unit 40) becomes 47 MPa, for example. Therefore, the fifth proportion changes to 82/47. Therefore, by setting the fifth set value, for example, at 82/46, detection of a gas leak from the fifth compressing unit 50 becomes possible.

Here, the embodiment will be outlined.

A gas leak determining method of the embodiment is a gas leak determining method for a multi-stage compressor including: a first compressing unit that compresses a gas; and a second compressing unit that further compresses the gas compressed by the first compressing unit, the gas leak determining method including: a step of calculating a proportion of discharge pressure from the second compressing unit to discharge pressure from the first compressing unit or suction pressure into the second compressing unit; and a step of determining that a gas is leaking from the second compressing unit when the proportion becomes equal to or less than a set value.

This gas leak determining method effectively detects that a gas is leaking from the second compressing unit at higher pressure than the first compressing unit. Specifically, even if a negligible gas (amount of leak allowable from a design viewpoint) is leaking from the second compressing unit, the proportion is an almost constant value. However, when a gas leaks from the second compressing unit resulting from deterioration of sealing of the suction valve or the discharge valve in the second compressing unit, wear of the piston ring, or other reasons, discharge pressure from the first compressing unit (suction pressure into the second compressing unit) will rise, thereby decreasing the proportion. Therefore, it becomes possible to determine that, when the proportion becomes equal to or less than a threshold, a gas is leaking from the second compressing unit.

Meanwhile, a multi-stage compressor of the embodiment includes: a first compressing unit compressible a gas; a second compressing unit compressible the gas compressed by the first compressing unit; and a determining unit. When a proportion of discharge pressure from the second compressing unit to discharge pressure from the first compressing unit or suction pressure into the second compressing unit becomes equal to or less than a set value, the determining unit determines that a gas is leaking from the second compressing unit.

This multi-stage compressor also effectively detects that a gas is leaking from the second compressing unit.

The invention claimed is:

1. A gas leak determining method for a multi-stage compressor including:

a first compressing unit that compresses a gas; and a second compressing unit that further compresses the gas compressed by the first compressing unit, the gas leak determining method comprising:

a step of calculating a proportion of discharge pressure from the second compressing unit to discharge pressure from the first compressing unit or suction pressure into the second compressing unit; and a step of determining that a gas is leaking from the second compressing unit when the proportion becomes equal to or less than a set value.

2. A multi-stage compressor comprising:

a first compressing unit compressing a gas;

a second compressing unit compressing the gas compressed by the first unit;

a first pressure sensor for detecting a discharge pressure from the first compressing unit or a suction pressure into the second compressing unit;

a second pressure sensor for detecting a discharge pressure from the second compressing unit; and a determining unit, wherein the determining unit includes a calculating section calculating a proportion of the discharge pressure from the second compressing unit detected by the second pressure sensor to the discharge pressure from the first compressing unit or the suction pressure into the second compressing unit detected by the first pressure sensor, and an output section determining that a gas is leaking from the second compressing unit when the proportion calculated by the calculating section becomes equal to or less than a set value.

* * * * *